US010538408B2

(12) United States Patent
Mordeglia et al.

(10) Patent No.: US 10,538,408 B2
(45) Date of Patent: Jan. 21, 2020

(54) MANAGEMENT METHOD FOR A COILER APPARATUS AND CORRESPONDING DEVICE

(71) Applicant: DANIELI AUTOMATION S.P.A., Buttrio (IT)

(72) Inventors: Antonello Mordeglia, Bangkok (TH); Giuseppe Buzzi, Pradamano (IT); Alessandro Ardesi, Udine (IT)

(73) Assignee: DANIELI AUTOMATION S.P.A., Buttrio (IT)

( * ) Notice: Subject to any disclaimer, the term of this patent is extended or adjusted under 35 U.S.C. 154(b) by 87 days.

(21) Appl. No.: 15/768,817

(22) PCT Filed: Oct. 17, 2016

(86) PCT No.: PCT/IB2016/056220

§ 371 (c)(1),
(2) Date: Apr. 16, 2018

(87) PCT Pub. No.: WO2017/064683

PCT Pub. Date: Apr. 20, 2017

(65) Prior Publication Data

US 2018/0305168 A1 Oct. 25, 2018

(30) Foreign Application Priority Data

Oct. 16, 2015 (IT) ..... 102015000062695

(51) Int. Cl.

| | |
|---|---|
| ***B65H 54/28*** | (2006.01) |
| ***B65H 54/12*** | (2006.01) |
| ***B21F 23/00*** | (2006.01) |

(52) U.S. Cl.
CPC ..... *B65H 54/2872* (2013.01); *B21F 23/002* (2013.01); *B65H 54/12* (2013.01);
(Continued)

(58) Field of Classification Search
None
See application file for complete search history.

(56) References Cited

U.S. PATENT DOCUMENTS 3,898,436 A * 8/1975 Pottebaum ..... B21C 47/00 377/2
4,570,875 A 2/1986 Buluschek
(Continued)

FOREIGN PATENT DOCUMENTS

EP 0602504 A1 6/1994
EP 0602504 B1 * 2/1998 ..... B65H 54/2875
(Continued)

OTHER PUBLICATIONS

International Search Report and Written Opinion for PCT/IB2016/056220, dated Jan. 20, 2017.

*Primary Examiner* — Mohammad Ali
*Assistant Examiner* — David Earl Ogg
(74) *Attorney, Agent, or Firm* — Marshall, Gerstein & Borun LLP

(57) ABSTRACT

Method and device to manage a coiler apparatus associated with a distributor, in which there is at least an exit of the feeder of hot or cold semi-worked metal products, and with a reel, both being respectively moved with suitable controlled movement and rotation means, able to manage the coiling obtaining coils with desired characteristics.

6 Claims, 3 Drawing Sheets

(52) U.S. Cl.
CPC ..... *B65H 54/2875* (2013.01); *B65H 2553/42* (2013.01); *B65H 2701/36* (2013.01)

(56) References Cited

U.S. PATENT DOCUMENTS

| | | | | |
|---|---|---|---|---|
| 4,741,500 | A * | 5/1988 | Lavanchy ..... | B65H 54/2872<br>242/478.2 |
| 6,443,385 | B1 | 9/2002 | Grandauer et al. | |
| 9,769,429 | B2 * | 9/2017 | Torben ..... | B66D 1/36 |

FOREIGN PATENT DOCUMENTS

| | | | |
|---|---|---|---|
| GB | 2221227 | A | 1/1990 |
| JP | H08188333 | A | 7/1996 |
| WO | WO-2014/068084 | A1 | 5/2014 |

* cited by examiner

MANAGEMENT METHOD FOR A COILER APPARATUS AND CORRESPONDING DEVICE

FIELD OF THE INVENTION

The present invention concerns a management method, and the corresponding device, for a hot or cold coiler apparatus, used by way of preferential example in the field of the steel industry.

In particular, the present invention is used to control, adjust and command the hot or cold coiling of semi-worked metal products arriving from steel plants, such as rod, wire, tubular elements or suchlike, used for example in the production of metal structures, for example to obtain reinforced concrete or other types of structure.

BACKGROUND OF THE INVENTION

Coiler apparatuses are known, able to make coils of hot or cold semi-worked metal products from steel plants for example, or secondary processing products, such as for example rod, wire, tubular elements or suchlike; hereafter in the description, the various types of metal products are all included in the term rod.

It is known that for certain applications, rod has a non-uniform surface conformation, that is, there are edges or thicker zones on its surface which modify its section, even continuously.

It is also known that very often coiling takes place with the rod still hot or very hot, and it is also known that in these cases the section of the rod is sensitive to the variations in temperature.

Known coiler apparatuses can have a rod distributor coordinated with a rotating reel around which the spirals of the coil are formed.

The known reel normally has a mandrel associated with containing elements that define the width of the coil, of which at least one can be dis-assembled to extract the coil.

Two main configurations of coiler apparatuses are known: a first in which the reel is in a vertical position and a second in which the reel is in a horizontal position.

In both known configurations, the rod distributor is positioned laterally in a position kept substantially median to the axis of the reel.

The distributor normally has a cadenced to-and-fro movement on a plane that advantageously comprises the center line of the exit of the distributor and advantageously, although not necessarily, the axis of the reel.

In another solution, the distributor can have at least one motion on a plane that, on each occasion as coiling proceeds, is configured tangent to a cylindrical surface having a variable diameter and generated by the axis of the reel.

The distributor can be positioned continuously along the width of the coil and/or in the radial position of the spiral.

To manage the coiling, in the state of the art, knowing the nominal values of the section of the rod is not sufficient to obtain a sufficiently precise control of the formation of the coil, optimizing the filling rate and preventing overlapping and/or empty spaces between adjacent spirals.

Therefore, during coiling, known apparatuses are not able to coordinate optimally the functionality of either the reel or the distributor, so that the spirals are positioned in the desired manner, in particular with the desired angle, in relation to the optimization parameters indicated above, depending on the section and characteristics of the rod.

The incorrect disposition of the spirals during coiling generates imperfections in the coil obtained such as, for example, empty spaces, non-saturation and overlapping, partial or total, of the spirals.

Coils obtained with known apparatuses, due to their imperfections, have a low coefficient of density of the spirals, said coefficient being given by the ratio between the actual volume of the spirals and the volume of total bulk of the coil.

The high number of imperfections in coils obtained with known apparatuses, together with the low density of the spirals, makes it unproductive, also in terms of time, to use them in the production of meshes, cages, trellises, brackets etc. for reinforced concrete structures or suchlike or others.

Indeed, it is known that in the case of products to be used to obtain reinforced concrete, the coils are uncoiled with suitable machines that, during uncoiling, if there is an imperfection, must be stopped to allow the operator to intervene.

This causes a loss of time that slows down production and requires the intervention of operators, increasing costs which, due to the competitive market where the products obtained are sold, must remain as low as possible, or at any rate limited but with the same quality.

In order to improve the quality of the coils, some devices are known, for example ring-type control and adjustment devices, with which the rod distribution system cooperates.

These known devices, once positioned and calibrated, are able to measure some parameters including, for example, the rod distribution speed, and are able to use the information collected to control and manage the coiling.

However, these known devices are not very reliable in measuring the parameters, which is performed indirectly, by detecting tensions and/or currents induced in the ring.

This means that the consequent adjustment of the rotation speed of the reel is also not very precise, and/or the speed of movement and/or the positioning of the distributor.

Moreover, these known devices are not only unable to detect the section of the rod, they must also be constantly coordinated with the distributor and on each occasion must be replaced and/or adapted according to the section of the rod.

Winding devices are also known, applied for example for electric wires or other similar materials, but these do not adapt to managing the coiling of rod because such devices do not consider the variability of the section of the product to be wound during coiling, nor the variability of the section as a function of the temperature.

Indeed, during the coiling of rods, the rods have very variable sections between two consecutive spirals, and are disposed distanced from each other with a variable pitch.

This makes known winding devices, used in other technical fields, unsuitable for use for apparatuses for coiling hot or cold semi-worked metal products.

For example, documents U.S. Pat. Nos. 4,570,875 and 6,443,385 describe management devices associated with a coiler apparatus for cables with a uniform section, which do not adapt the action of the distributor in a manner coordinated with the rotation of the reel as a function of the variability of the section of the cable and the distance between two consecutive spirals, which in this case are always constant.

There is therefore a need to perfect the state of the art and make available a management method for a coiler apparatus, and the corresponding device, which overcome at least one of the disadvantages of the state of the art.

In particular, the purpose of the present invention is to improve the reliability of the direct detection of the instantaneous parameters of the rod and to condition the way the coil is formed on the basis of this.

Another purpose of the present invention is to improve the precision of the adjustment of the reel, in coordination with that of the distributor, to obtain desired positions both of the spirals and the layers of the coil, in order to prevent imperfections and/or residual tensions.

Another purpose is that the management device for coiler apparatuses according to the present invention can be applied to existing coilers, without necessarily being replaced and/or adapted according to the variability of the section of the rod.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

The present invention concerns a management method and device for a coiler apparatus, suitable to improve the management of the rod during coiling and to obtain improved coils.

In accordance with said purposes, a management device for a coiler apparatus, and the corresponding method, provide to use at least a video recording system.

The video recording system is able to collect and process images of the distribution of the rod at the coiling speed.

The management device, on receiving the video signals, is able to process them and possibly intervene on the operating parameters of the coiler apparatus so as to obtain the desired result.

According to the invention, the video recording system is suitable to focus on the rod at least in the space that goes from the exit of the feeder, or distributor, to the reel.

According to a variant, the management device is able to measure point-by-point, at least on the plane that comprises the axis of the distributor, the angle of inclination of the rod comprised between the axis of the feeder of the distributor and the instantaneous winding point on the reel, with respect to the nominal zero.

According to one characteristic of the present invention, the management device for a coiler apparatus has means able to process the data acquired during coiling and to intervene at least on the coordination of the movement systems of the distributor of the rod and the reel, to keep the angle of inclination of the rod at a desired value.

Furthermore, in one embodiment, the management device coordinates the movement systems of the rod and the reel according both to the desired distance between the spirals and also their radial position on the reel.

According to another characteristic of the present invention, the management device can be associated with existing coiler apparatuses since it is suitable to work both on all types and sizes of rod, and also on all types of coil.

According to another characteristic of the present invention, the management device advantageously has at least a source of structured light system associated with a surface of the rod and/or with the reel and/or the distributor.

By the term source of structured light, here and hereafter in the description, we mean to include a laser source, leds, a lamp with a suitable distributor grid and/or other type of light source suitable for the purpose.

The source of structured light system is suitable to emit one or more beams of structured light that intersect the surface of the rod and/or reel and/or distributor.

According to a first embodiment of the invention, the video recording system detects the presence, in a defined position, of the beam/beams of structured light, acquires the parameters thereof and interacts with a control and command unit of the management device.

The source of structured light system allows the control and command unit of the management device to define the reference spatial coordinates useable to process the images collected by the video recording system.

According to one characteristic of the present invention, the management method uses at least the speed of rotation of the reel and the speed of movement of the distributor as adjustment parameters.

According to a variant, the management method also allows to control and/or optimize the position of the distributor in a radial direction to the reel.

The management method according to the present invention allows to identify the correct parameters for the desired distribution of the rod on the reel and to calculate the suitable modification to be possibly made according to the desired position of the spirals depending on the coiling moment.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
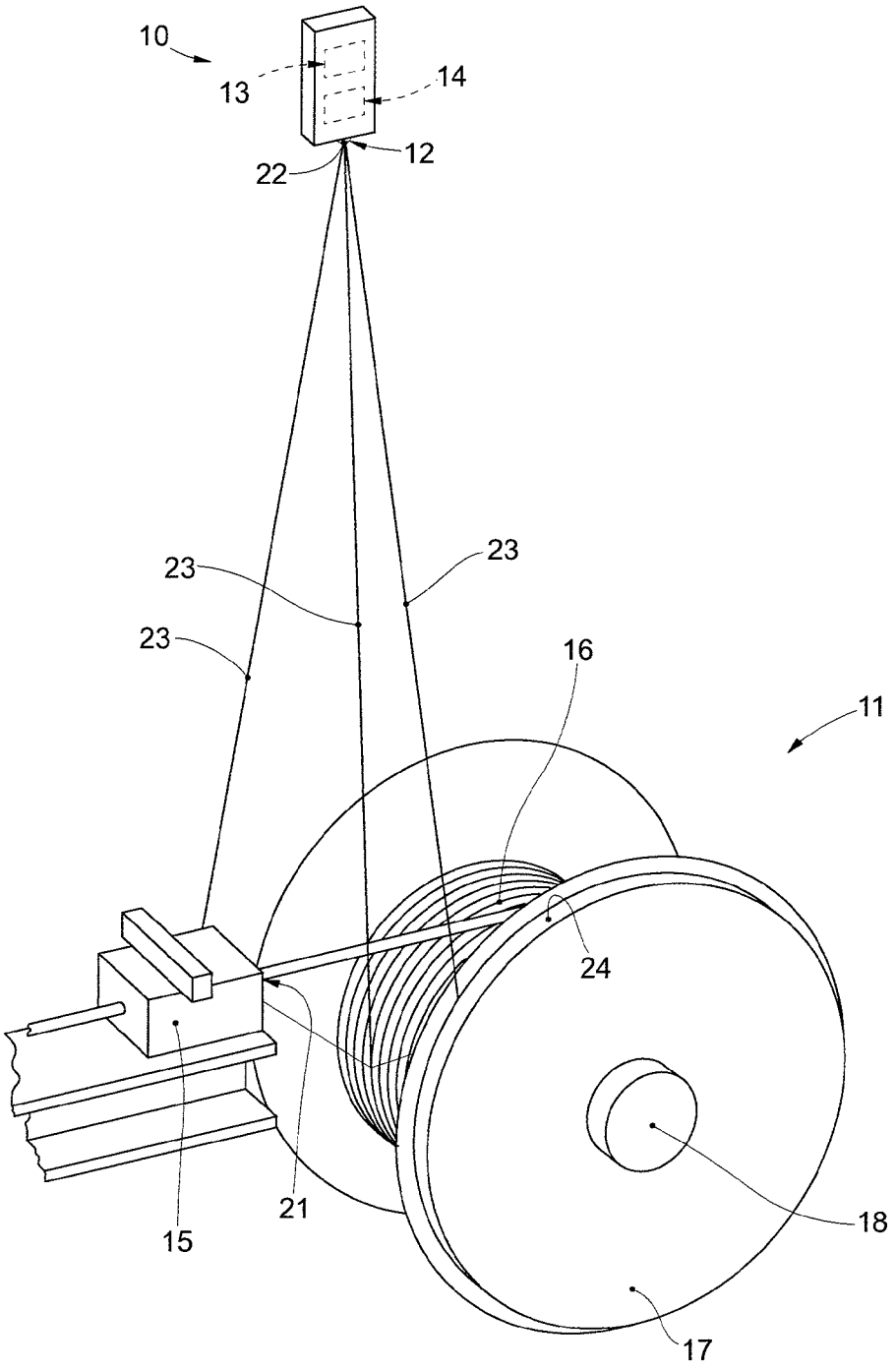
FIG. 1 is a perspective view of a management device for a coiler apparatus according to the present invention.
Figure 2A:
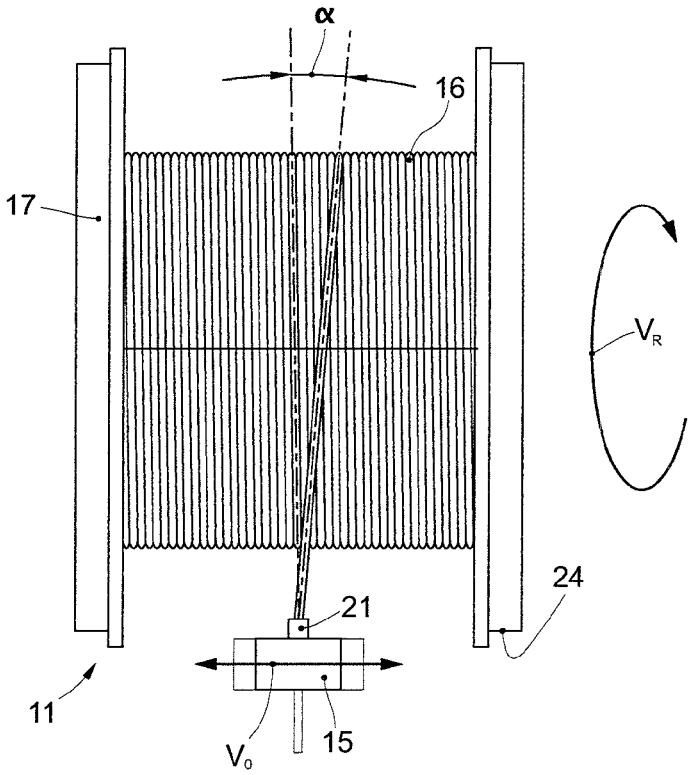
FIG. 2*a* is a view from above of FIG. 1 that shows a visual field of a management device for a coiler apparatus according to the present invention.
Figure 2B:
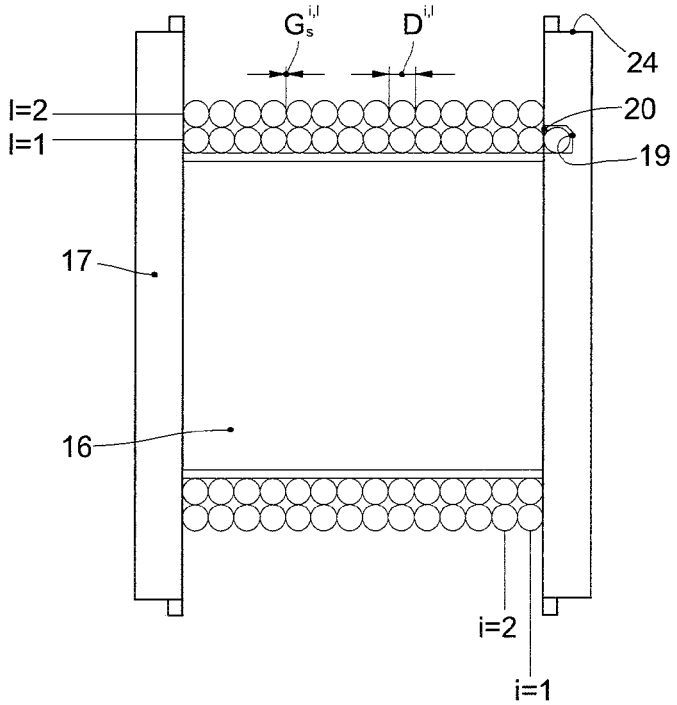
FIG. 2*b* is a view in section of FIG. 2*a* of a coiler apparatus associated with a management device according to the present invention.

With reference to FIG. 1, a management device 10 associated with a coiler apparatus 11 according to the present invention comprises at least a video recording system 12, a processing and calculating unit 13 and a control and command unit 14.

The coiler apparatus 11 comprises a rod distributor 15 associated and able to be coordinated with a reel 16.

The distributor 15 and the reel 16 are conformed and positioned in a known manner to be moved respectively with specific movement and rotation means, adjustable in a desired and controlled manner.

The reel 16 is associated, at its two ends, with containing elements 17, or flanges, cooperating with a mandrel 18, which not only contain and support the coil but also allow to define its sizes.

Furthermore, at least one of the containing elements 17 can be dis-assembled to remove the coil obtained.

Advantageously, in at least one of said containing elements 17 there is a suitable housing seating 19 associated with an attachment mean 20 of one end of the rod, to prepare the rod at start-of-coiling.

In this case, the distributor 15 can move parallel to the axis of the mandrel 18 along the lateral extension between the containing elements 17.

According to a variant, not shown, the distributor 15 is able to be positioned, on each occasion, also in relation to the specific layer being coiled.

In particular, the distributor 15 supplies rod continuously, and in a desired and controlled manner, from the exit of the feeder 21 to the reel 16, positioning the rod progressively on desired surfaces parallel to the axis of the reel 16.

According to the invention, the movement of the distributor 15 is performed keeping the exit of the feeder 21 facing toward the specific surface temporally affected during coiling.

The video recording system 12 cooperates with a processing and calculating unit 13 and a control and command unit 14 which can be located near to or far from the video recording system 12.

In particular, the processing and calculating unit 13 and the control and command unit 14 can be autonomous entities, dedicated to the control of the coiling system, or parts of a general control unit that also manages apparatuses disposed upstream and/or downstream of the coiler apparatus and interacting with it.

According to a variant, the video recording system 12 also cooperates with a source of structured light system 22 configured to emit one or more beams of structured light 23 intersecting the surface of the rod and/or the reel 16 and/or the distributor 15 and detectable by the video recording system 12.

In particular, the beam or beams of structured light 23, which by way of non-restrictive example can be laser beams, leds or other type, are associated with the surface of the rod and/or the distributor 15 and/or a surface of the reel 16, and specifically are advantageously associated with at least an external surface 24 of at least one of said containing elements 17.

The source of structured light system 22, cooperating with at least the video recording system 12, allows the management device 10 to define the reference spatial coordinates useable for processing the images collected by the video recording system 12. With this, it is also possible to associate the management device 10 with existing coiler apparatuses 11 which have both the reel 16 in a horizontal position and also in a vertical or inclined position.

The video recording system 12 incorporates image capturing means such as, for example, a charge-coupled image detector (CCD) or other similar device.

In order to have a visual field suitable to detect operating coiling parameters, the video recording system 12 focuses on the rod at least at exit from the feeder 19 to the reel 16.

Furthermore, the video recording system 12 is able to collect the images at a speed coordinated with the desired coiling speed.

The processing and calculating unit 13, for example consisting of integrated circuits and/or microprocessors, processes the images collected by the video recording system 12 to acquire one or more operating coiling parameters thereof.

According to a variant, the processing and calculating unit 13 is able to measure point-by-point, on the plane that comprises the axis of the distributor 15, at least the angle of inclination $\alpha$ of the rod.

The angle of inclination $\alpha$ is defined between the axis of the feeder of the distributor 15 and the instantaneous coiling point on the reel 16 with respect to nominal zero.

According to a variant, the processing and calculating unit 13 is able to measure point-by-point the equivalent diameter of the section of the rod during coiling.

The control and command unit 14, for example consisting of integrated circuits and/or microprocessors cooperating with suitable actuators, is associated by the movement and rotation means respectively with the distributor 15 and the reel 16 by means of specific connections and/or remote command systems (not shown).

Furthermore, once the operating coiling parameters have been processed, the control and command unit 14 is able to verify that they are the ones desired, according to the specific coiling moment.

If there is discordance between the control operating parameters and the desired parameters, the control and command unit 14 adjusts the operating speeds of the distributor 15 and the reel 16 in a coordinated manner.

According to one embodiment of the present invention, the method corresponding to the management device 10 for a coiler apparatus 11 comprises at least:

- a step of positioning the management device 10 in relation to the coiler apparatus 11, disposing the video recording system 12 so that it focuses on the rod at least in the space comprised from the exit of the feeder 21 to the reel 16;
- a possible step of aligning the source of structured light system 22 so as to define the orientation of the video recording system 12 with respect to the distributor 15 and/or the reel 16;
- a possible step of initial positioning and clamping the rod from the distributor 15 in the housing seating 19 associated with the attachment mean 20;
- a step of inserting data in the control and command unit 14 of the desired reference operating coiling parameters;
- a step of collecting images from the video recording system 12 during coiling, the collecting being coordinated with the coiling speed;
- a step of processing the images and calculating the operating parameters thus obtained by means of the processing and calculating unit 13;
- a step of controlling by comparing the operating parameters obtained with the reference operating parameters previously inserted in the control and command unit 14;
- a possible step of converting the possible differences between the desired operating coiling parameters with those detected in suitable and coordinated variations of the movement of the distributor 15 and/or of the speed of rotation of the reel 16.

According to the invention, the management method uses an algorithm to calculate the speed of the movement mean of the distributor 15 and the speed of rotation of the reel 16, necessary point-by-point during coiling, depending on the desired position of the spiral and the layer of the coil.

The algorithm can be summarized in the following functional expressions:

$$V_R = f_1(V_R^{i,l}, \Delta V_R^{FB})$$

$$V_D = f_2(V_D^{i,l} \Delta V_D^{FB})$$

where:

f1 and f2 express two functional relations that link the speeds of movement of the distributor 15 and of the reel 16; with the parameters between round brackets the index i and the index l refer respectively to the i-th winding rotation and the l-th layer of the coil;

$V_R$ is the speed of rotation of the reel 16;

$V_D$ is the speed of the movement mean of the distributor 15;

$V_R^{i,l}$ is the speed of rotation of the reel 16 corresponding to the i-th rotation of the l-th layer;

$V_D^{i,l}$ is the speed of the movement mean of the distributor 15 corresponding to the i-th rotation of the l-th layer;

$\Delta V_R^{FB}$ is the variation in the speed of rotation of the reel 16 proportional to the difference between the desired operating coiling parameters inserted and the operating parameters detected;

$\Delta V_D^{FB}$ is the variation in the speed of the movement mean of the distributor 15 proportional to the difference between the desired operating coiling parameters inserted and the operating parameters detected.

According to the invention, for every desired coiling there is at least one specific relation between the spiral in the i-th position and the layer in the l-th position and at least one operating parameter, for example the angle of inclination $\alpha$ of the rod.

Said relation is defined by the data inserted in the control and command unit 14 and can be determined by a suitable calibration.

The parameter $V_D^{i,l}$ depends, at rotation i and at layer 1, on the parameter $V_R^{i,l}$ and the equivalent diameter $D^{i,l}$ distanced from the previous one by a length $G_S^{i,l}$.

According to the invention there is a relation between the parameter $G_S^{i,l}$ and the speeds of the movement mean of the distributor 15 ($V_D$) and the speed of rotation of the reel ($V_R$).

Consequently, since there is a relation between the speeds $V_R$ and $V_D$ and the angle of inclination $\alpha$ of the rod, the parameter $G_S^{i,l}$ which determines the desired position of the spirals can be controlled. The control of the parameter $G_S^{i,l}$ is obtained by measuring the angle of inclination $\alpha$. Possibly, the parameters $G_S^{i,l}$ can be modified, in correspondence with every rotation i and/or every layer 1, intervening on the speeds of the movement mean of the distributor 15 and the reel 16.

The variations in speed $\Delta V_R^{FB}$ and $\Delta V_D^{FB}$ are determined continuously during coiling, so as to prevent imperfections and/or residual tensions and to have a desired positioning of the spirals with every rotation i and with every layer 1.

Figure 3:
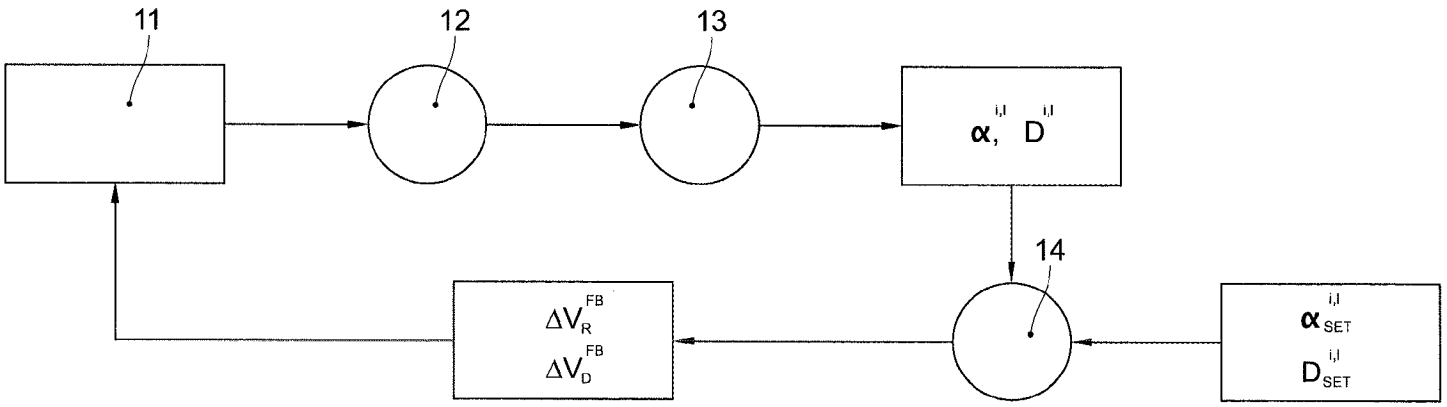
FIG. 3 is a simplified block diagram that shows the method to manage a coiler apparatus according to the present invention.

FIG. 3 shows a block diagram that gives an example of the management method for a coiler apparatus 11 according to the present invention.

In this example, the angle of inclination $\alpha_{SET}^{i,l}$ and the equivalent diameter $D_{SET}^{i,l}$ of the semi-worked product to the i-th rotation and to the l-th layer are inserted as operating reference coiling parameters.

The method shown in a simplified manner in FIG. 3 provides initially a step of inserting the desired reference operating parameters in the control and command unit 14.

The video recording system 12 acquires the images during coiling and sends them to the processing and calculating unit 13.

The processing and calculating unit 13 calculates continuously the operating parameters and sends them to the control and command unit 14.

The control and command unit 14 compares the parameters obtained with the reference operating parameter previously inserted.

If there is a difference between the reference operating parameters and the operating parameters obtained, the control and command unit 14 converts the differences into suitable and coordinated variations in the movement of the distributor 15 and/or the speed of rotation of the reel 16 ($\Delta V_R^{FB}$, $\Delta V_D^{FB}$).

The control and command unit 14 possibly commands the distributor 15 and/or the reel 16, varying respectively their speeds of movement and of rotation.

The process is repeated for each i-th rotation and each l-th layer until the coil is completed.

It is clear that modifications and/or additions of parts may be made to the management device for a coiler apparatus, and the corresponding method, as described heretofore, without departing from the field and scope of the present invention.

It is also clear that, although the present invention has been described with reference to some specific examples, a person of skill in the art shall certainly be able to achieve many other equivalent forms of management device for a coiler apparatus, and the corresponding method, having the characteristics as set forth in the claims and hence all coming within the field of protection defined thereby.

The invention claimed is:

1. A management method for a coder apparatus provided with a distributor, in which there is at least an exit of the feeder of semi-worked hot or cold metal products, a reel, and a management device comprising a video recording system focusing on a semi-worked metal product, said distributor and said reel being respectively moved by controlled movement and rotation means, wherein said management method comprises:

inserting data in a control and command unit of said management device of the reference operating coiling parameters, said reference operating parameters being at least a desired angle of inclination ($\alpha_{SET}^{i,l}$), and a diameter ($D_{SET}^{i,l}$) corresponding to said semi-worked metal product to an i-th rotation of said reel and to an l-th layer of the coil being formed, said angle of inclination ($\alpha_{SET}^{i,l}$) being defined between an axis of said exit from the feeder and the instantaneous coiling point of said semi-worked metal product on said reel, collecting the video images, at a specific speed, from said video recording system during coiling, the speed is determined such that the collecting of the video images is coordinated with an actual coiling speed;

processing the video images and calculating at least operating parameters ($\alpha^{i,l}$, $D^{i,l}$) by means of a processing and calculating unit of said management device, said operating parameters being at least said angle of inclination ($\alpha^{i,l}$) and said equivalent diameter ($D^{i,l}$) of said semi-worked metal product;

comparing said operating parameters ($\alpha^{i,l}$, $D^{i,l}$) obtained from the collection of video images with said reference operating parameters ($\alpha_{SET}^{i,l}$, $D_{SET}^{i,l}$) inserted in the control and command unit;

converting the differences between said reference operating parameters ($\alpha_{SET}^{i,l}$, $D_{SET}^{i,l}$) and said operating parameters ($\alpha_{SET}^{i,l}$, $D_{SET}^{i,l}$), into mutually dependent variations ($\Delta V_D^{FB}$, $\Delta V_R^{FB}$) of the speed of movement ($V_D$) of said distributor and/or of speed of rotation ($V_R$) of said reel, wherein the coordinated variations comprise:

$\Delta V_R^{FB}$ is the variation in the speed of rotation of said reel proportional to the difference between the reference operating coiling parameters and the operating parameters detected;

$\Delta V_D^{FB}$ is the variation in the speed of the movement mean of said distributor proportional to the difference between the reference operating coiling parameters and the operating parameters detected;

adjustment of the speed of movement ($V_D$) of said distributor and of the speed of rotation ($V_R$) of said reel based on the variations, respectively;

wherein the adjustment produces the desired coiling speed, such that the actual coiling speed changes to the desired coiling speed;

wherein the collecting of video images will automatically adjust to the change in the coiling speed.

2. The management method as in claim 1, and further comprising at least a step of calibrating said operating coiling parameters ($\alpha^{i,l}$, $D^{i,l}$) with at least the speed of movement ($V_D^{i,l}$) of said distributor and the speed of rotation ($V_R^{i,l}$) of said reel for each rotation and each layer of the coiling.

3. The management method as in claim 1, wherein to control and/or adjust the speed of movement ($V_D$) of said distributor and the speed of rotation ($V_R$) of said reel at least one of the following functional relations are adopted:

$$V_R = f_1(V_R^{i,l}, \Delta V_R^{FB})$$

$$V_D = f_2(V_D^{i,l} \Delta V_D^{FB})$$

where:

f1 and f2 express two functional relations that link the speeds of movement of the distributor and of the reel;

the index (i) and the index (l) respectively identify the i-th winding rotation and the l-th layer of the coil;

$V_R$ is the speed of rotation of said reel;

$V_D$ is the speed of the movement mean of said distributor;

$V_R^{i,l}$ is the speed of rotation of said reel corresponding to the i-th rotation of the l-th layer;

$V_D^{i,l}$ is the speed of the movement mean of said distributor corresponding to the i-th rotation of the l-th layer;

$\Delta V_R^{FB}$ is the variation in the speed of rotation of said reel proportional to the difference between the reference operating coiling parameters and the operating parameters detected;

$\Delta V_D^{FB}$ is the variation in the speed of the movement mean of said distributor proportional to the difference between the reference operating coiling parameters and the operating parameters detected.

4. The management method as in claim 3, wherein said speed of movement ($V_D^{i,l}$) and said speed of rotation ($V_R^{i,l}$) are mutually dependent, and said speed of movement ($V_D^{i,l}$) also depends on the distance ($G_S^{i,l}$) between said equivalent diameter ($D^{i,l}$) and the previous equivalent diameter ($D^{i-l,l}$).

5. The management method as in claim 4, wherein said distance ($G_S^{i,l}$) depends on said angle of inclination ($\alpha^{i,l}$).

6. A management device for a coiler apparatus provided with a distributor, in which there is at least one exit of a feeder of semi-worked metal products, and a reel, respectively moved by suitable controlled movement and rotation means, said management device comprising a video recording system configured to acquire images of said semi-worked metal product, wherein said management device comprises:

a processing and calculating unit configured to process said images and calculate continuously obtained operating parameters comprising an equivalent diameter ($D^{i,l}$) of said semi-worked metal product and an angle of inclination ($\alpha^{i,l}$) defined between an axis of said exit of the feeder and an instantaneous coiling point of said semi-worked metal product on said reel;

a control and command unit configured to control the obtained operating parameters ($\alpha^{i,l}$, $D^{i,l}$) with previously supplied reference operating parameters for the equivalent diameter and angle of inclination ($\alpha_{SET}^{i,l}$, $D_{SET}^{i,l}$), and to command in a coordinated manner said movement and rotation means of said distributor and said reel and wherein the control and command unit is configured to convert the differences between the obtained operating parameters ($\alpha^{i,l}$, $D^{i,l}$) and the previously supplied reference operating parameters ($\alpha_{SET}^{i,l}$, $D_{SET}^{i,l}$) into mutually dependent variations ($\Delta V_D^{FB}$, $\Delta V_R^{RB}$) of speed of movement ($V_D$) of said distributor and/or of speed of rotation ($V_R$) of said reel, wherein the coordinated variations comprise:

$\Delta V_R^{FB}$ is the variation in the speed of rotation of said reel proportional to the difference between the reference operating coiling parameters and the operating parameters detected;

$\Delta V_D^{FB}$ is the variation in the speed of the movement mean of said distributor proportional to the difference between the reference operating coiling parameters and the operating parameters detected;

wherein adjustment of the speed of movement ($V_D$) of said distributor and of the speed of rotation ($V_R$) of said reel is based on the variations, respectively;

wherein the adjustment produces a desired coiling speed, such that an actual coiling speed changes to the desired coiling speed; and wherein the collecting of video images will automatically adjust to a change in the coiling speed.

* * * * *